United States Patent [19]

Foley

[11] Patent Number: 4,662,706

[45] Date of Patent: May 5, 1987

[54] ELECTRICAL DEVICE

[75] Inventor: Robert G. Foley, Fremont, Calif.

[73] Assignee: Elcon Products International Company, Fremont, Calif.

[21] Appl. No.: 727,053

[22] Filed: Apr. 25, 1985

[51] Int. Cl.[4] ..... H01R 11/22

[52] U.S. Cl. ..... 339/256 R; 339/252 R; 339/258 R

[58] Field of Search ..... 339/252 P, 252 R, 256 R, 339/256 RT, 257, 258 R, 258 P, 258 RR, 262 R, 262 RR, 262 P, 276 T, 278 T

[56] References Cited

U.S. PATENT DOCUMENTS

| | | | |
|---|---|---|---|
| 3,086,190 | 4/1963 | Neidecker et al. | 339/252 P |
| 4,087,152 | 5/1978 | Kolm | 339/256 R |
| 4,128,293 | 12/1978 | Paoli | 339/258 R |
| 4,596,438 | 6/1986 | Nygard | 339/252 R |

*Primary Examiner*—Gil Weidenfeld
*Assistant Examiner*—Paula A. Austin
*Attorney, Agent, or Firm*—Townsend and Townsend

[57] ABSTRACT

An electrical contact device for use as part of an electrical contact unit. The device comprises a body having a central part and a pair of end parts, one of the end parts adapted to be coupled to a wire and the other end part defining an extension which is removably received within a second, tubular contact element forming another part of the electrical contact unit. A sleeve surrounds the extension and is spaced therefrom to present an annular space for receiving the tubular element. A male contact band surrounds and is coupled to the extension and a female contact band is carried within the sleeve. Both bands have electrically conductive, curved contact members which project into the annular space from opposite directions and contact the inner and outer surfaces, respectively, of the tubular element when the same is in the annular space between the extension and the sleeve. The bands provide for an increase in current-carrying capability for the unit, lower contact resistance and minimum temperature rise due to current flow through the bands. Several different ways of connecting a wire to the device are disclosed.

8 Claims, 10 Drawing Figures

ELECTRICAL DEVICE

This invention relates to improvements in the construction of electrical contact devices, and, more particularly, to an improved electrical contact device which has increased current-carrying capability.

BACKGROUND OF THE INVENTION

In conventional electrical contact devices in which a tubular electrical element fits onto a jack-like electically conductive contact extension of electrical device body secured to a wire, the inner surface of the element directly contacts the outer surface of the extension of the device. This electrical contact typically is not satisfactory because of surface irregularities in the mating surfaces of the element and the extension. This causes a limitation in the amount of current that can be carried across the junction of the mating surfaces because of the relatively high contact resistance. Because of such resistance, the voltage drop is relatively high and a relatively high increase in temperature of the mating surfaces occurs due to the high contact resistance.

The foregoing drawbacks are significant in that they represent circuit losses which are not acceptable. As a result, more expensive equipment is needed to avoid such losses, thereby increasing circuit costs considerably. Because of these drawbacks, a need exists for improvements in electrical contact units in which two parts are releasably interconnected. The present invention satisfies this need.

SUMMARY OF THE INVENTION

The present invention is directed to a contact device which includes a jack-like extension at one end of the device, the extension being surrounded by a sleeve to define an annular space for telescopically receiving a tubular contact element inserted in the space. Male and female contact bands are mounted on the outer surface of the extension and on the inner surface of the sleeve, respectively, and the contact bands have curved, resilent contact members which project outwardly into the space defined by the extension and the sleeve. The contact members of the bands are thus in a position to engage the inner and outer surfaces of the tubular contact element when the element is inserted into the space. Thus, in this way, the device will have a much higher current-carrying capacity, will have lower contact resistance (lower voltage drop) and therefore a lower temperature rise at the junction between the device and the element.

The contact device of the present invention is simple and rugged in construction, can be produced at minimum cost and can be quickly and easily assembled notwithstanding the enhanced electrical characteristics thereof.

The primary object of the present invention is to provide an improved electrical contact device which is provided with a pair of electrical contact bands which cooperate with each other to provide additional surface contact between the device and a tubular contact element inserted in an annular space formed by the extension on the device and a sleeve surrounding the device to thereby provide an increased current-carrying capability for the device with lower contact resistance to thereby minimize the temperature rise at the contact junction between the device and the element.

Other objects of this invention will become apparent as the following specification progresses, reference being had to the accompanying drawings for an illustration of the invention.

IN THE DRAWINGS

Figure 1:
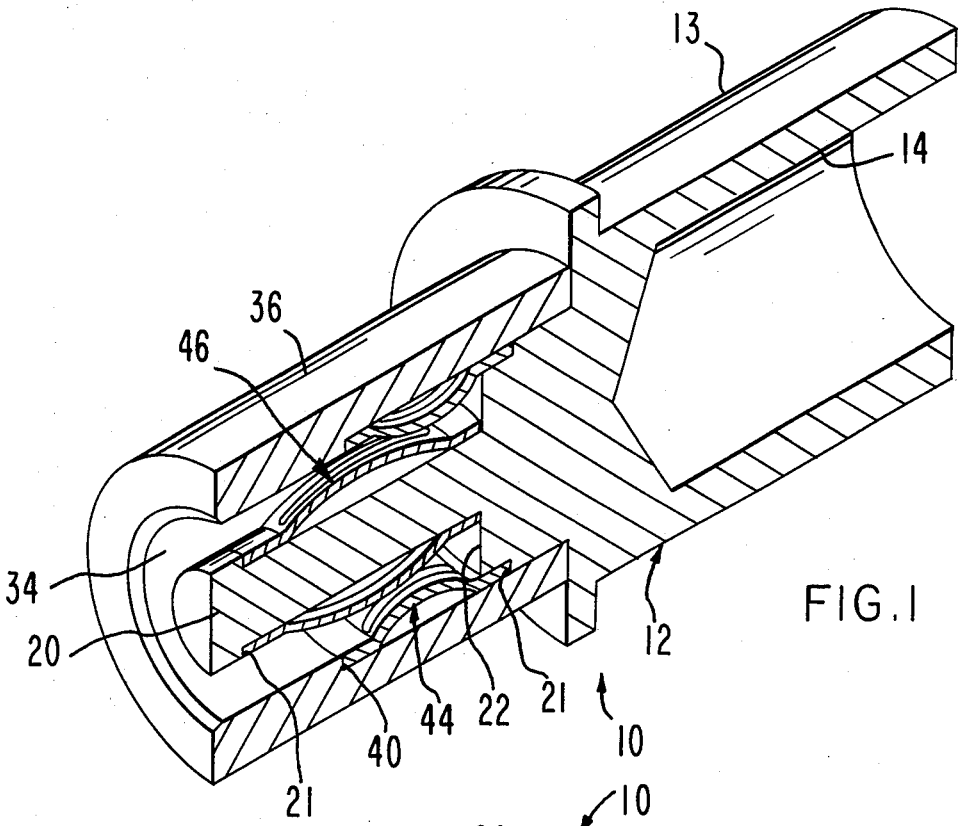
FIG. 1 is a perspective view of a section of the improved electrical contact device of the present invention, showing the male and female contact bands on an extension and within a sleeve, respectively.

The improved electrical contact device of the present invention is broadly denoted by the numeral 10 and includes a one-piece body 12 of electrically conductive material, such as copper or brass. Body 12 has a central part 18 and a first end part 13 provided with an internal bore 14 extending outwardly from the central part in one direction. The inner end of the bore terminates near central part 18. A rod-like extension 20 integral with central part 18 extends outwardly therefrom in the opposite direction away from bore 14, extension 20 defining a second end part for body 12.

Extension 20 is generally cylindrical and has a first, annular outer shoulder 21 near the outer end thereof. A second annular shoulder 22 is on central part 18 near the inner end of extension 20. There is a third annular shoulder 24 on central part 18 spaced axially from shoulder 22 and being of a greater diameter than shoulder 22 as shown in FIG. 2.

Figure 2:
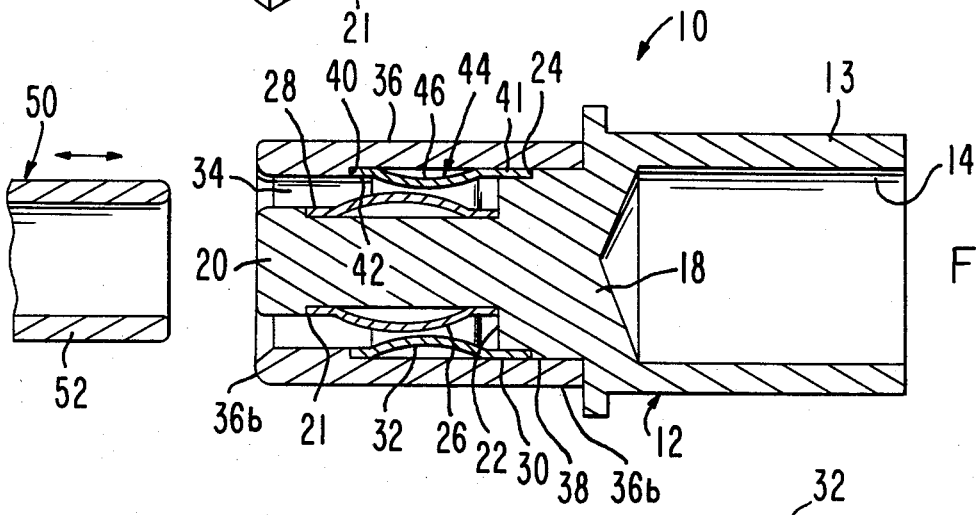
FIG. 2 is a vertical section through the device of FIG. 1.
Figure 3:
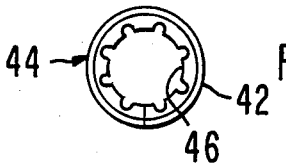
FIGS. 3 and 4 are end and side elevational views, respectively, of the female device.
Figure 5:
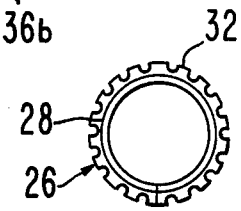
FIGS. 5 and 6 are end and side elevational views, respectively, of the male contact band.
Figure 4:
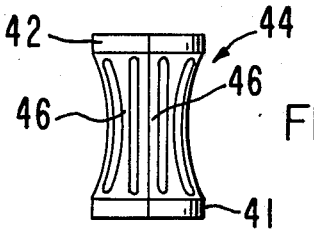
Figure 6:
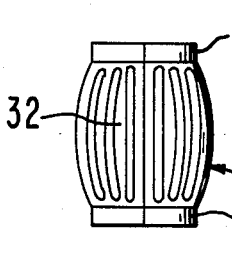

An electrically conducting male contact band 26 (FIGS. 5 and 6) is mounted in place on and in surrounding relationship to the major portion of extension 20 as shown in FIGS. 1 and 2, band 26 having a pair of annular end segments 28 and 30 interconnected by a plurality of spaced, resilient, curved bridging members 32. The end faces of segments 28 and 30 are generally flat and engage respective, adjacent shoulders 21 and 22 as shown in FIG. 2 when band 26 is in place in an operative position with the inner surfaces of segments 28 and 30 are in engagement with and surround extension 20. Thus, in the operative position of male band 26 on extension 20, contact members 32 project into an annular space 34 which is formed when a tubular, electrically conducting sleeve 36 is mounted on body 12 with the end **36*a* of sleeve 36 press-fitted on an annular boss 38 integral with central part 18 of body 12. The outer end 36*b* is adjacent to, is spaced from and surrounds the outer end of extension 20. Male band 26 is generally of a split ring construction to facilitate its being easily placed on extension 20**.

Sleeve 36 has an annular shoulder 40 which is at the same level as shoulder 24 of annular boss 38 when the sleeve is mounted as shown in FIG. 2. Shoulders 24 and 40 are adapted to be engaged by respective annular end segments 41 and 42 of a female electrical contact band 44 which is electrically conductive and has resilient, curved bridging members 46 which project into space 34 and are adjacent to members 32 as shown in FIGS. 1 and 2. Members 46 are resilient in the same manner as members 32 so that members 32 and 46 will move apart while making electrical contact with a tubular electrical contact element inserted into space 34 as hereinafter described.

Contact device 10, in use, is adapted to be coupled with a tubular electrical contact element denoted by the numeral 50 and having a sleeve-like, electrically conducting part 52 which is adapted to be telescopically received within space 34. As element 50 is inserted into space 34, it engages members 32 and 46 of bands 26 and 44, respectively, and forces the members 32 and 46 away from each other while the members remain in electrical contact with the inner and outer surfaces, respectively, of element 50. Thus, the present invention provides greater surface area contact between bands 26 and 44 and element 50 to provide a higher current-carrying capacity, lower contact resistance, i.e., lower voltage drop, and lower temperature rise in the contact parts.

Figure 7:
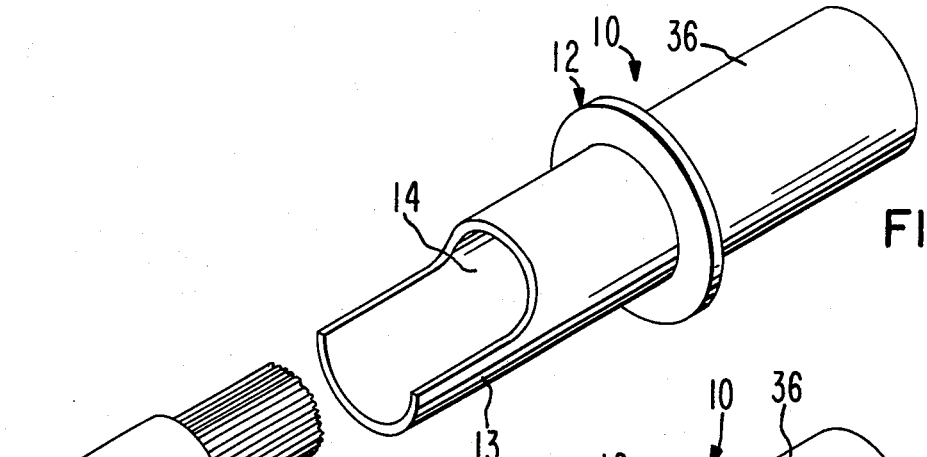
FIGS. 7–10 are perspective views of the electrical contact device of the present invention, showing several ways of coupling the ends of a wire to the device.
Figure 8:
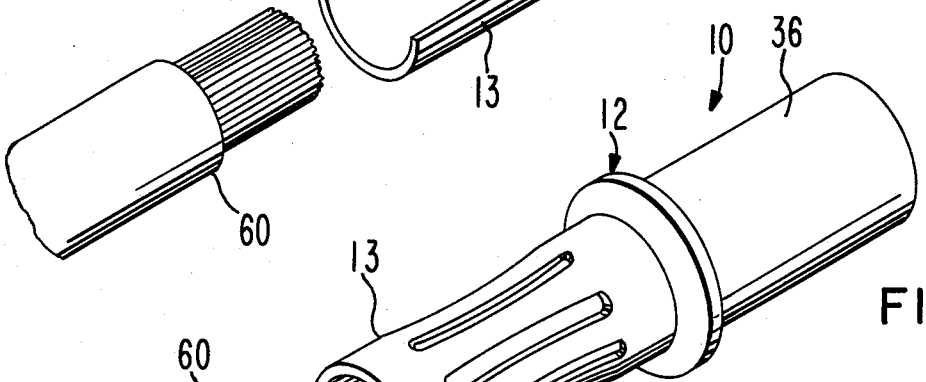
Figure 9:
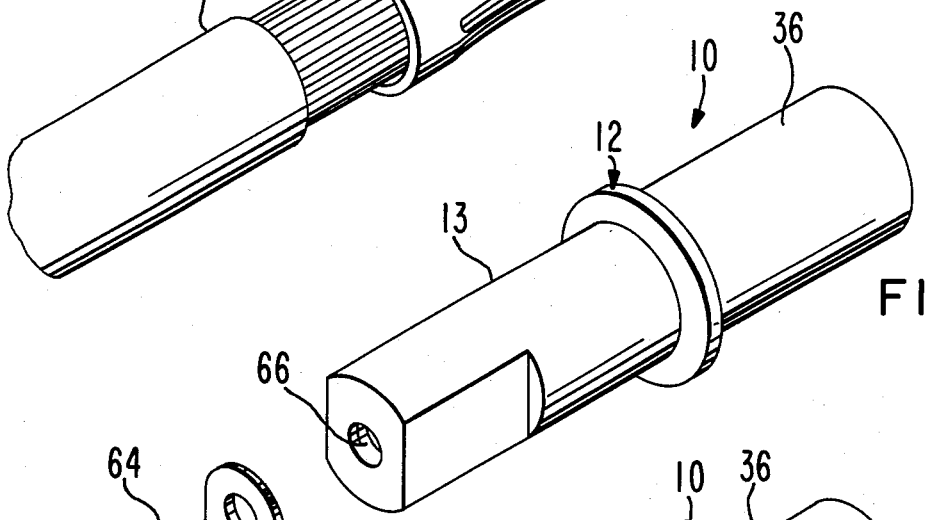
Figure 10:
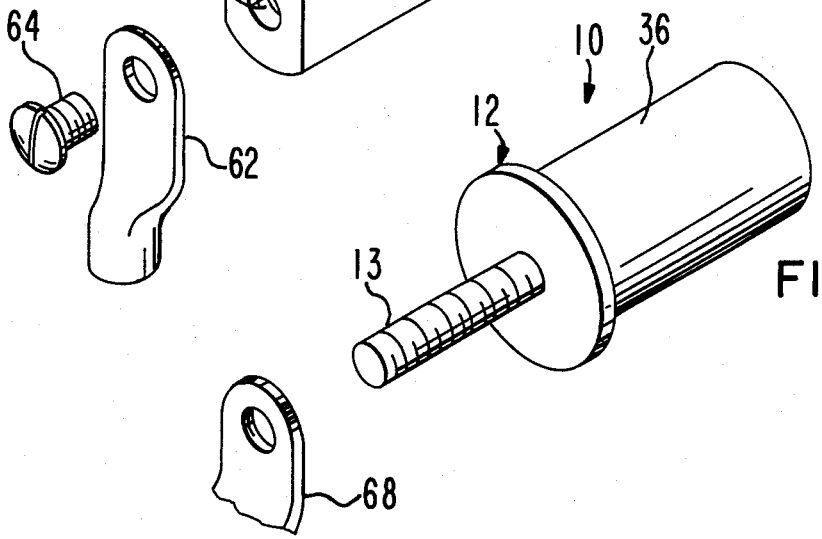

Body 12 can be provided with an electrical wire in any one of the several ways shows in FIGS. 7–10. In FIG. 7, wire 60 can be coupled by solder in bore 14 of body 12. The end part 13 can be cut away as is well known to permit solder to be easily placed in the bore 14. In FIG. 8, wire 60 can be coupled by crimp means on end part 13 of body 12. FIG. 9 shows a lug 62 for connection to a wire (not shown), and a screw 64 will attach the lug to body 12 by threading into a threaded bore 66 in an end face of part 13 of body 12. A threaded post (FIG. 10) defining end part 13 can be threadably coupled to a lug 68 to which a wire is attached.

The present invention provides an improved electrical contact device which can be made at minimal cost yet can be used to increase the current-carrying capacity of the device by at least a factor of 2 while keeping the contact resistance to a minimum and without causing temperature increases in the region of the electrical contact between body 12 and element 50. All of the foregoing can be achieved with simple, relatively easily produced parts capable of being quickly assembled.

What is claimed is:

1. An electrical contact device comprising:

a body having a central part and a pair of end parts;

means on one of the end parts for connecting a wire thereto, there being an extension defining the other end part;

an electrically conductive sleeve removably coupled to the central part and surrounding the extension in spaced relationship thereto to present an annular space between the sleeve and the extension, said space being open at one end and adapted to removably receive a tubular electrical contact element; and means removably coupled on each of the extension and the sleeve, respectively, for making electrical contact with said tubular element when the latter is inserted into the space.

2. A contact device as set forth in claim 1, wherein said contact-making means includes a first contact band on the extension and a second contact band within and in electrical contact with the sleeve, each band having a number of resilient contact members projecting into said space.

3. A contact device as set forth in claim 2, wherein each contact member is curved.

4. A contact device as set forth in claim 2, wherein each contact band has a pair of generally annular end segments and a plurality of resilient contact members bridging the distance between the respective end segments.

5. An electrical contact device comprising:

a body having a central part and a pair of end parts;

means on one of the end parts for connecting a wire thereto, there being an extension defining the other end part;

an electrically conductive sleeve coupled to the central part and surrounding the extension in spaced relationship thereto to present an annular space between the sleeve and the extension, said space being open at one end and adapted to removably receive a tubular electrical contact element;

a first contact band on the extension; and a second contact band within and in electrical contact with the sleeve, each band having a number of resilient contact members projecting into said space for making electrical contact with said tubular element when the latter is inserted into the space, the body having a pair of spaced shoulders for engagement by and for the positioning of the first contact band on the extension, said central part and said sleeve having shoulder means for engagement by and positioning of the second contact band in the sleeve.

6. An electrical contact device comprising:

a body having a central part and a pair of end parts, said central part having an annular boss;

means on one of the end parts for connecting a wire thereto, there being an extension defining the other end part;

an electrically conductive sleeve having a cylindrical end portion press-fitted over and in electrical contact with the boss and surrounding the extension in spaced relationship thereto to present an annular space between the sleeve and the extension, said space being open at one end and adapted to removably receive a tubular electrical contact element; and means on the extension and the sleeve for making electrical contact with said tubular element when the latter is inserted into the space.

7. An electrical contact device comprising:

a body having a central part and a pair of end parts;

means on one of the end parts for connecting a wire thereto, there being an extension defining the other end part;

an electrically conductive sleeve coupled to the central part and surrounding the extension in spaced relationship thereto to present an annular space between the sleeve and the extension, the central part of the body having an annular flange defining a stop for limiting the travel of the sleeve axially of the extension, said space being open at one end and adapted to removably receive a tubular electrical contact element; and means on the extension and the sleeve for making electrical contact with said tubular element when the latter is inserted into the space.

8. An electrical contact device comprising:

a body having a central part and a pair of end parts;

means on one of the end parts for connecting a wire thereto, there being an extension defining the other end part;

an electrically conductive sleeve coupled to the central part and surrounding the extension in spaced relationship thereto to present an annular space between the sleeve and the extension, said space being open at one end and adapted to removably receive a tubular electrical contact element; and a pair of electrical contact bands for the extension and the sleeve, respectively, for making electrical contact with said tubular element when the latter is inserted into the space, said bands being split to facilitate placement of one of the bands on the extension and the other band in the sleeve.

* * * * *